US006463744B1

(12) United States Patent
Alexeev et al.

(10) Patent No.: US 6,463,744 B1
(45) Date of Patent: Oct. 15, 2002

(54) METHOD AND DEVICE FOR PRODUCING COLD

(75) Inventors: Alexander Alexeev; Hans Quack, both of Dresden (DE)

(73) Assignee: Messer Griesheim GmbH (DE)

( * ) Notice: Subject to any disclaimer, the term of this patent is extended or adjusted under 35 U.S.C. 154(b) by 0 days.

(21) Appl. No.: 09/674,948

(22) PCT Filed: Apr. 30, 1999

(86) PCT No.: PCT/EP99/02932

§ 371 (c)(1),
(2), (4) Date: Nov. 6, 2000

(87) PCT Pub. No.: WO99/58905

PCT Pub. Date: Nov. 18, 1999

(30) Foreign Application Priority Data

May 12, 1998 (DE) ..... 198 20 961
May 13, 1998 (DE) ..... 198 21 308

(51) Int. Cl.[7] ..... F25B 9/00
(52) U.S. Cl. ..... 62/6; 62/114
(58) Field of Search ..... 62/6, 114

(56) References Cited

U.S. PATENT DOCUMENTS 4,831,828 A * 5/1989 Klusmier et al. ..... 62/6
5,337,572 A * 8/1994 Longsworth ..... 62/114
5,617,739 A * 4/1997 Little ..... 62/114

* cited by examiner

*Primary Examiner*—Ronald Capossela
(74) *Attorney, Agent, or Firm*—Connolly Bove Lodge & Hutz LLP

(57) ABSTRACT

In a process for refrigeration in the 65 to 150 K temperature range, in which the refrigerant is compressed using an oil-lubricated compressor, then cooled to ambient temperature and then oil is removed from the refrigerant before the refrigerant is fed to a Joule Thomson heat exchanger, the refrigerant is additionally cooled after it has been cooled to ambient temperature and before it enters the Joule Thomson heat exchanger. In a device for refrigeration in the 65 to 150 K temperature range, which has an oil-lubricated compressor for compressing a refrigerant, an aftercooler connected downstream for cooling the refrigerant to ambient temperature, a device following on from this for removing oil from the refrigerant and a Joule Thomson countercurrent heat exchanger connected downstream of the device for removing the oil, an oil condenser is arranged between the aftercooler and the Joule Thomson countercurrent heat exchanger.

20 Claims, 6 Drawing Sheets

METHOD AND DEVICE FOR PRODUCING COLD

Figure 1:
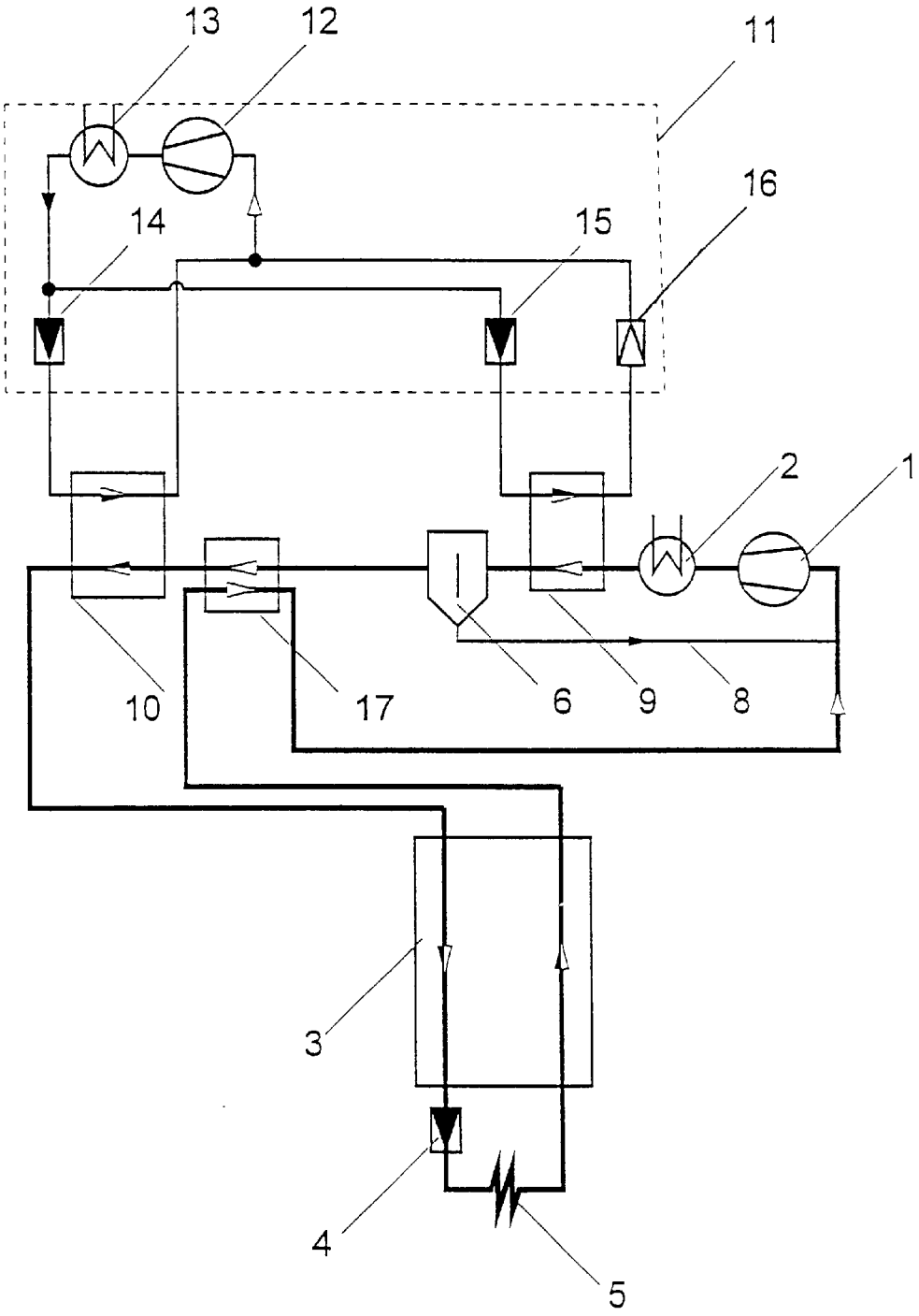

The invention relates to a process for refrigeration in the 65 to 150 K temperature range, in which the refrigerant is compressed using an oil lubricated compressor, then cooled to ambient temperature and then oil is removed from the refrigerant before the refrigerant is fed to a Joule Thomson heat exchanger. The invention furthermore relates to a device for refrigeration in the 65 to 150 K temperature range, which has an oil-lubricated compressor for compressing a refrigerant, an aftercooler connected downstream for cooling the refrigerant to ambient temperature, a device following on from this for removing oil from the refrigerant and a Joule Thomson countercurrent heat exchanger connected downstream of the device for removing the oil.

According to the prior art, processes are known for refrigeration in the 65 to 150 K temperature range. In these processes, a refrigerant gas is compressed in a compressor from a relatively low pressure (low pressure) to a relatively high pressure (high pressure) and cooled to ambient temperature in an aftercooler. The compressed refrigerant is then cooled in the high pressure flow in a heat exchanger in countercurrent with the as yet uncompressed refrigerant, and finally expanded using a throttle valve to bring it into the two-phase range for the refrigerant. Following the expansion, the liquid component of the refrigerant is partially evaporated in an evaporator with the output of refrigerating power. The refrigerant leaving the evaporator is fed in the low pressure flow to the countercurrent heat exchanger and warmed in it by the compressed refrigerant. Finally, the warmed refrigerant is fed back to the compressor.

Mixtures of gases with standard boiling points below 320 K are often used as the refrigerant. These include, for example, hydrogen, nitrogen, oxygen, noble gases, hydrocarbons and halogenated hydrocarbons. The processes described above are referred to, when such mixtures of substances are used as the refrigerant, as "mixture Joule Thomson processes".

For the compression of the refrigerant, it is advantageous to use an oil-lubricated compressor. The service interval for oil-lubricated compressors is, at over 20,000 operating hours, relatively long. This guarantees a high degree of reliability for the overall refrigerating system since there are no other components with mechanical moving parts.

The use of an oil-lubricated compressor has the associated disadvantage that oil can enter the refrigerant from the compressor and can thus be entrained into the refrigerating cycle. If the oil enters the cold part of the refrigerating system, then it freezes at the low temperatures occurring in the evaporator and obstructs the evaporator. The compressor must therefore have appropriate components connected downstream of it in order to separate oil from the refrigerant after the latter has been compressed. Because of the relatively high temperatures of the compressed refrigerant, both aerosol and vapour oil components are generally present in the refrigerant. As the cleaning unit, it may be advantageous to use a liquid/oil separator with oil return to the compressor and an adsorber connected downstream to extract oil vapour components and any ultrafine droplets still remaining. This arrangement has already been described (R. C. Longsworth, M. J. Boiarski, L. A. Klusmier, 80 K Closed Cycle Throttle Refrigerator, Proceedings of the 8th International Cryocooler Conference, Vail Co., June 1994).

An adsorber is a container filled with adsorbent. Solids which, because of their properties, can bind other substances, in this case the oil, are used as adsorbents. The adsorption process involves build-up of molecules from the gas or liquid phase on the solid surface of the adsorbent. Activated charcoal, silica gel and zeolites (molecular sieves) are primarily used as adsorbents. In a mixture Joule Thomson process, the oil droplets and the oil vapour build up in the adsorber on the inner surface of the adsorbent.

The operating procedure for an adsorber is discontinuous. The adsorber is loaded when the entire inner surface of the adsorbent is occupied by the foreign molecules. The adsorber can then no longer fulfil its function. For this reason, the adsorber is replaced or regenerated at regular intervals. The time between replacement or regeneration of the adsorber disadvantageously determines the service interval of the overall refrigerator. A normal service interval is in the 5000 to 10,000 operating hours range.

A further disadvantage of adsorbers is the selectivity of the adsorbent with respect to particular components of a refrigerant mixture, that is to say its property of differentially adsorbing different components (H. Jungnickel, R. Agsten, W.-E. Kraus, Grundlagen der Kältetechnik [Fundamentals of refrigeration], Verlag Technik GmbH, 1990, p. 309). On flowing through the adsorber, the composition of the mixture becomes shifted for this reason generally in favour of the components with low boiling points.

The efficiency of a mixture Joule-Thomson process depends strongly on the composition of the refrigerant mixture. During the constant circulation of the refrigerant mixture, components with higher boiling points are adsorbed more and more in the adsorber, so that the overall composition changes. The change in the composition leads to substantial deterioration of the characteristics of the system and the required refrigerating power or refrigeration temperature are no longer achieved. It is then necessary to replace the refrigerant mixture.

This disadvantageous effect of the selectivity of the adsorbent on the composition of the refrigerant mixture becomes commensurately greater as the volume of the adsorber increases. It is not therefore sensible to increase the volume of the adsorber in order to extend the service interval in terms of becoming loaded with oil, because the composition of the refrigerant mixture will at the same time become altered by this, generally with negative repercussions.

For the thermodynamic efficiency of the refrigerant mixture cycle, it is important to use particular refrigerant mixture compositions. The main selection criterion for the composition is the size and distribution of the temperature difference between the high and low pressure flows in the Joule Thomson heat exchanger. The temperature difference should be as small as possible, and the distribution of the temperature difference in the heat exchanger should be as uniform as possible.

Refrigerant mixtures which provide a particularly favourable temperature difference distribution in the heat exchanger are usually not in the gas phase, but partially liquefied before entering the Joule Thomson heat exchanger. This is achieved by adding components with higher boiling points, for example propane or isobutane (A. Alexeev, H. Quack, Ch. Haberstroh, Low cost mixture Joule Thomson Refrigerator, Cryogenics, Proceedings of the 16th International Cryogenic Engineering Conference, Kitakyushu, Japan, 1996).

The components of the mixture with higher boiling points generally also have a higher freezing point. At low temperatures in the cold part, these components could freeze and obstruct the evaporator. For this reason, the proportion of components with higher boiling points in the refrigerant mixture should be as low as possible. The advantages of using refrigerant mixtures are thus not fully exploited, and the efficiency which might potentially be obtained is not achieved. This is a further disadvantage of the mixture Joule Thomson processes known in the prior art.

The object of the invention is to increase the efficiency of the mixture Joule Thomson process with oil-lubricated compressors. The degree of efficiency of the process and of the device for refrigeration is to be increased and the service interval for an adsorber, if one is provided, and therefore the refrigeration device is to be extended.

According to the invention, the object is achieved in that the refrigerant is additionally cooled after it has been cooled to ambient temperature and before it enters the Joule Thomson heat exchanger.

The device for the additional cooling will here be referred to as an oil condenser. This is because, surprisingly, the relatively minor additional cooling advantageously makes other oil components condense from the refrigerant flow to a considerable extent.

The device is particularly advantageously suitable for refrigeration in the 90 to 110 K temperature range.

According to the invention, it is proposed that the refrigerant is additionally cooled after it has been cooled to ambient temperature and before the oil is removed.

According to the invention, it is also proposed that the refrigerant is additionally cooled after the oil has been removed and before entering the Joule Thomson heat exchanger. For this purpose, after the oil has been removed, the refrigerant flow is advantageously cooled in another heat exchanger (precooler), so that the refrigerant is in partially liquefied form in the Joule Thomson heat exchanger. The heat exchangers for cooling the high pressure flow to below ambient temperature, i.e. the oil condenser and precooler, advantageously obtain their refrigerating power from a refrigerating system.

According to the invention, predominantly liquid oil components are removed from the refrigerant after the refrigerant has been cooled to ambient temperature. If the partial pressure of the oil vapors in the flow of the compressed refrigerant downstream of the liquid/oil separator is less than about $10^{-3}$ mbar, or if the desired evaporation temperature is above 120 K, then in the process according to the invention, technically viable purity of the refrigerant may already be achieved by additional cooling in the oil condenser advantageously only with a liquid/oil separator as the oil separation stage.

According to the invention, the refrigerant has a temperature of from 233 to 243 K before entering the Joule Thomson heat exchanger.

It is proposed according to the invention that the pressure of the refrigerant is from 1 to 3 bar, preferably from 1.5 to 2.5 bar and particularly preferably from 1.6 to 1.8 bar before it enters the oil-lubricated compressor, and that the refrigerant has a pressure from 10 to 28 bar, preferably from 12 to 18 bar and particularly preferably from 14 to 16 bar after it has been compressed in the oil-lubricated compressor.

According to the invention, it is also proposed, after the predominantly liquid oil component has been removed from the refrigerant, then to remove the predominantly vapour oil component from the refrigerant. The removal is advantageously carried out with a liquid/oil separator and an adsorber connected downstream, the oil droplets which the refrigerant flow contains being precipitated in the liquid/oil separator and the remaining refrigerant flow, then with minor vapour oil components, being purified further in an adsorber. The oil vapors from the refrigerant gas after compression condense out quite readily and are quite readily precipitated in the liquid/oil separator. The concentration of the residual oil in the refrigerant gas downstream of the liquid/oil separator is relatively low, which substantially relieves the burden on the adsorber. A relatively cold refrigerant flows through the adsorber, and therefore cools it. The specific capacity of the adsorbent in the adsorber is thus increased compared with processes according to the prior art, and the service interval for the adsorber and therefore for the overall refrigeration device is increased.

Furthermore, when refrigerant mixtures are used, it may be advantageous to reduce the proportion of components with higher boiling points. This is because even before entering the Joule Thomson heat exchanger, such refrigerant mixtures are partially liquefied. As a result of this, at the same time, the efficiency of the system is increased and the risk of these components freezing at low temperatures in the cold part of the system is substantially reduced.

According to the invention it is proposed to use as the refrigerant a mixture which contains nitrogen, methane, propane and ethane or ethylene. The mixture preferably contains from 25 to 45 mol % nitrogen, from 15 to 42 mol % methane and from 5 to 15 mol % propane, the remainder being ethane or ethylene. The advantage is that the refrigerant mixture consists of relatively few components. Components with standard boiling point at ambient temperature, for example isobutane, are no longer needed. The development of refrigerant mixtures and maintenance of the refrigerant mixture are thereby significantly simplified.

The object is furthermore achieved by a refrigeration device in which an oil condenser is arranged between the aftercooler and the Joule Thomson countercurrent heat exchanger.

According to the invention, the oil condenser is arranged after the aftercooler and before an oil separation device.

In accordance with the invention, an adsorber is arranged after the oil separation device and before the Joule Thomson countercurrent heat exchanger.

According to the invention, a precooler is arranged after the aftercooler and after the oil separation device.

In accordance with the invention, it is proposed that the oil condenser and/or the precooler are integrated as the evaporator in a separate refrigerating cycle.

According to the invention, it is proposed that a heat exchanger is arranged after the oil separation device or after the adsorber and before the precooler.

In accordance with the invention it is proposed that the precooler is configured as a triple-flow heat exchanger through which the refrigerant flow from the Joule Thomson heat exchanger and the flow of refrigerant from the separate refrigerating cycle are fed in countercurrent to the refrigerant flow from the oil separation device or the adsorber.

Figure 2:
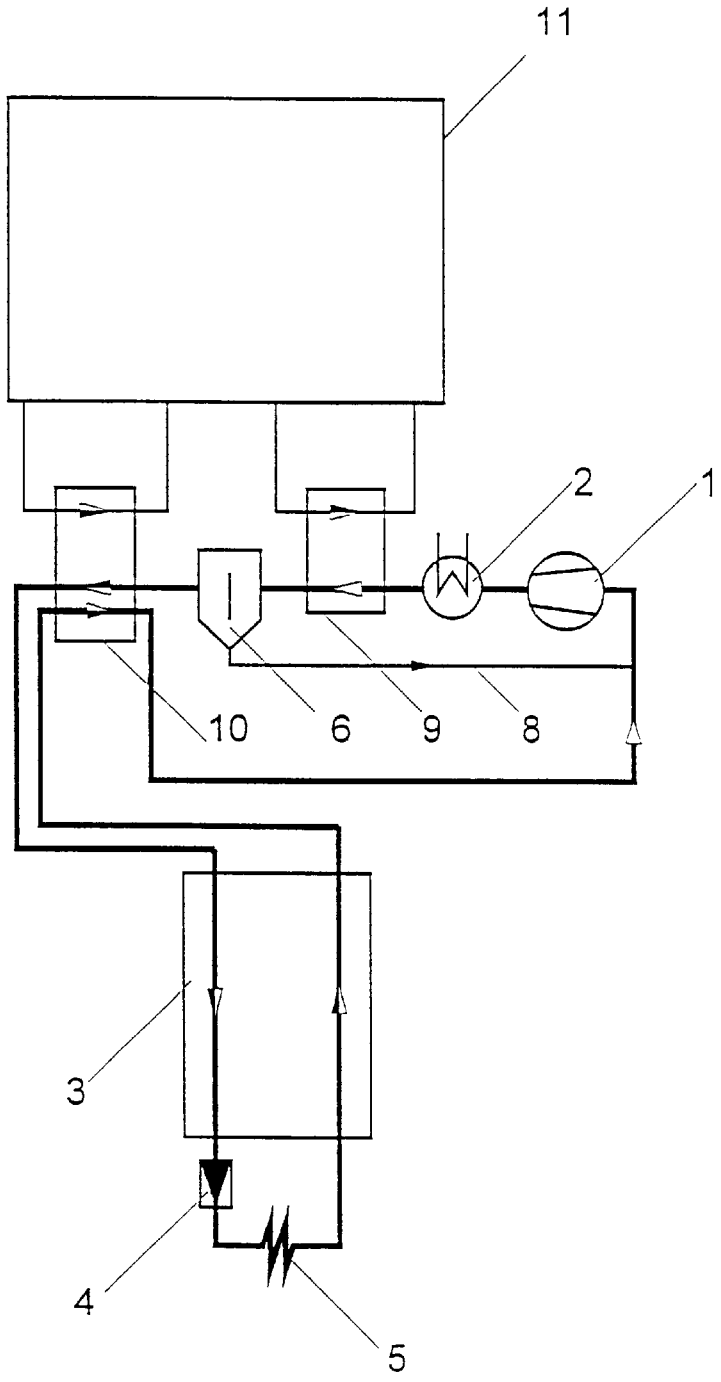
Figure 3:
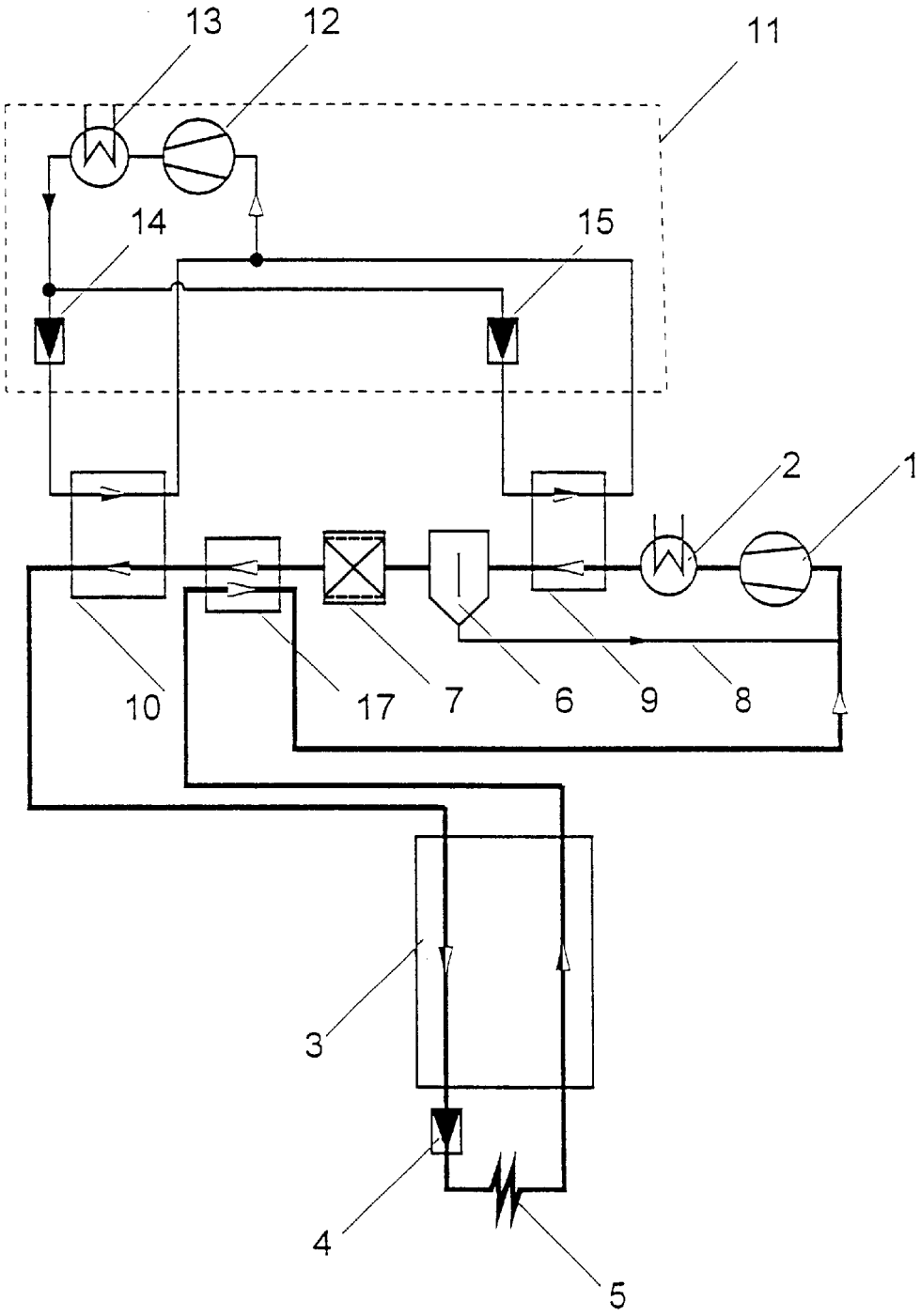
Figure 4:
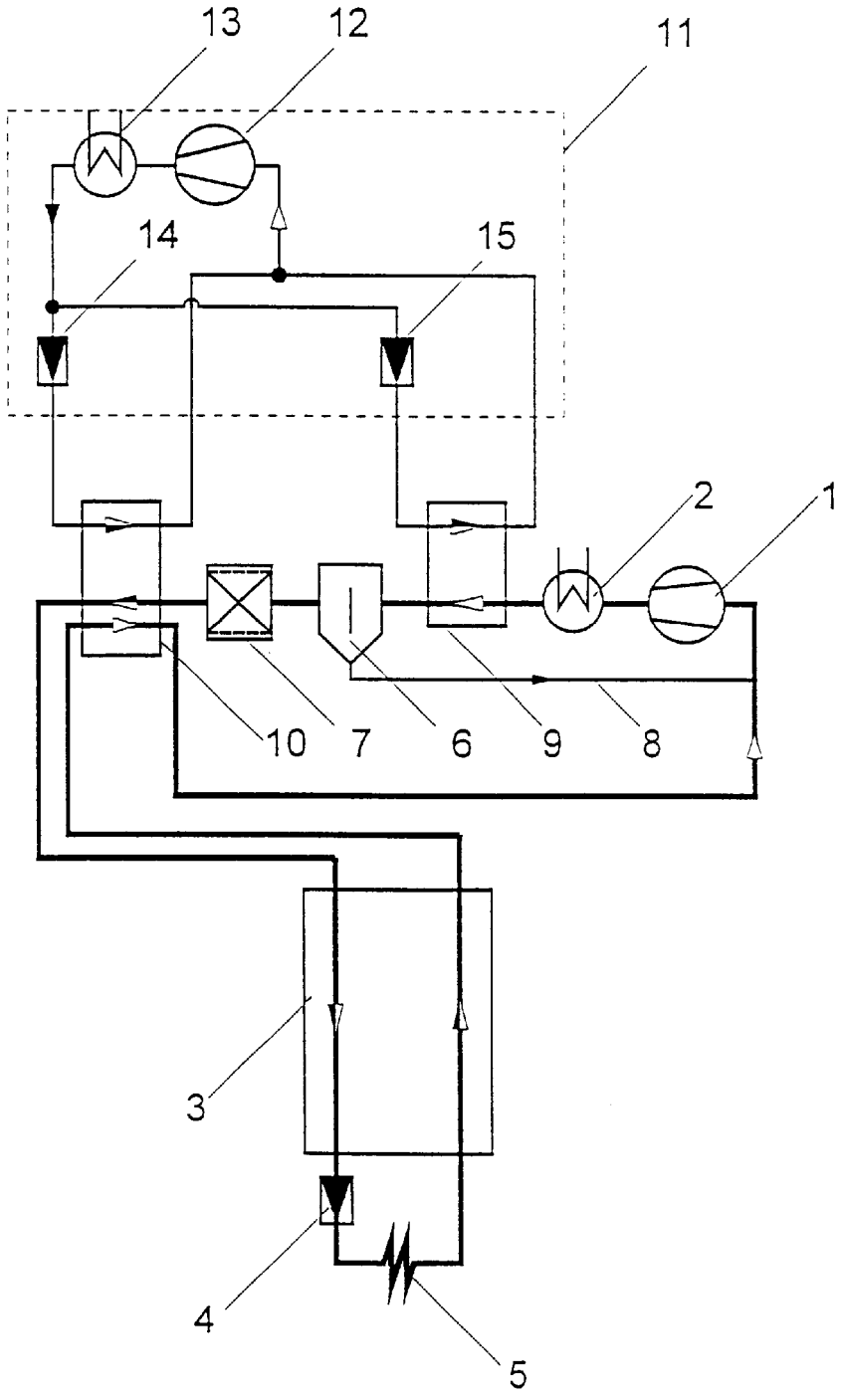
Figure 5:
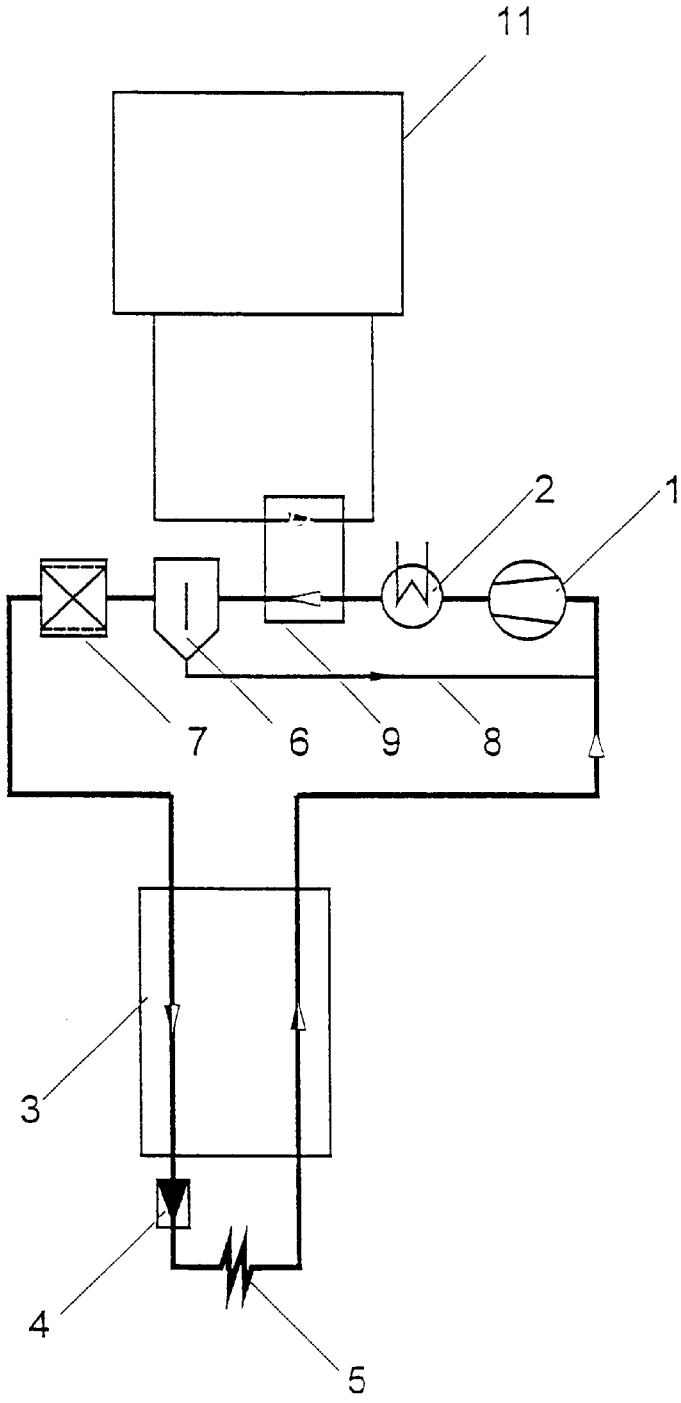
Figure 6:
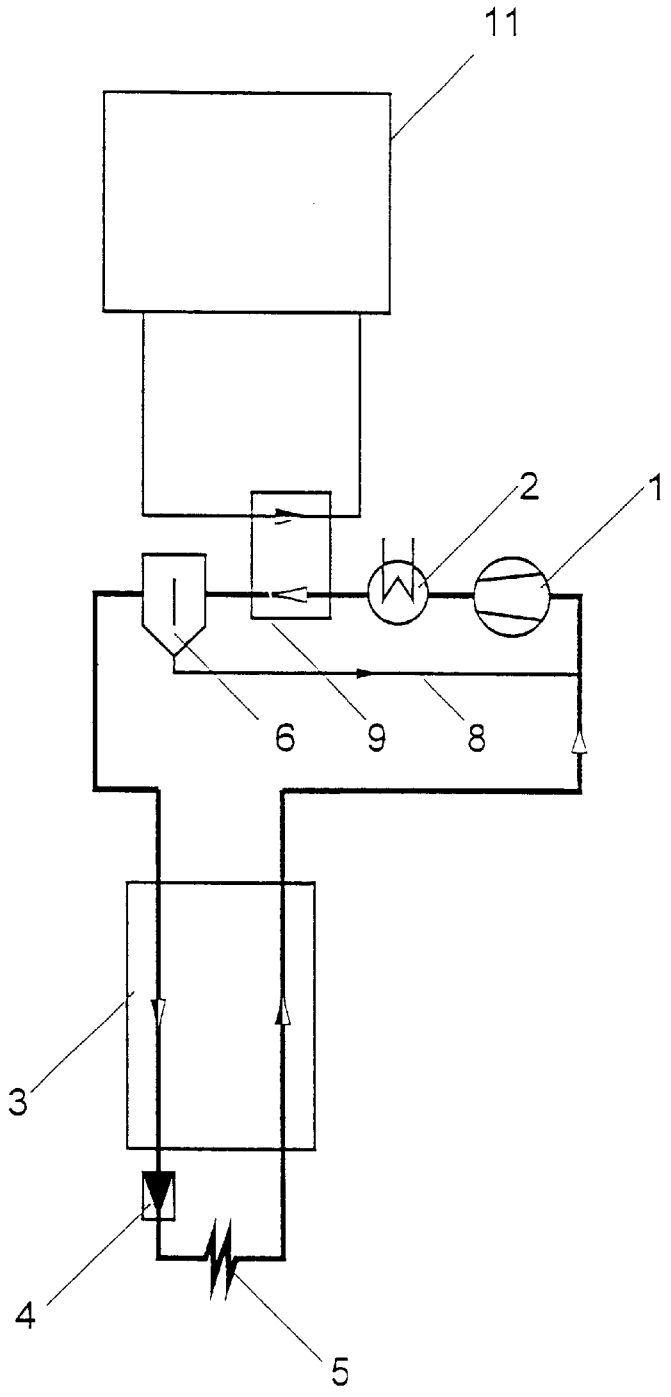

The invention will now be explained in more detail by way of example with reference to drawings (FIG. 1 to FIG. 6), in which:

FIG. 1 shows a schematic representation of a mixture Joule Thomson refrigerator with an oil-lubricated compressor and with oil recycling, and with additional cooling of the high pressure flow, FIG. 2 shows a schematic representation of a variant of the mixture Joule Thomson refrigerator according to FIG. 1 with an oil-lubricated compressor and oil recycling with additional cooling of the high pressure flow, FIG. 3 shows a schematic representation of a refrigerator according to FIG. 1 with an additional adsorber, FIG. 4 shows a schematic representation of a refrigerator according to FIG. 2 with an additional adsorber, FIG. 5 shows a schematic representation of a refrigerator without a precooler but with an additional adsorber, and FIG. 6 shows a schematic representation of a device without a precooler and without an adsorber.

FIG. 1 represents a device for carrying out a mixture throttle process. This process may be regarded as a modified Joule Thomson process. The device consists of an oil-lubricated compressor 1, an aftercooler 2, a Joule Thomson heat exchanger 3, a throttle component 4, an evaporator 5, a liquid/oil separator 6, a capillary line 8, an oil condenser 9, a precooler 10, a heat exchanger 17 and a refrigerating system 11.

The mixture compressed in the compressor 1 is cooled in the aftercooler 2 to ambient temperature. The refrigerant is then precooled in the oil condenser 9 to below ambient temperature, with the mixture remaining in the gas phase. The subsequent removal of the oil from the refrigerant mixture takes place in two stages. First, oil droplets and oil aerosol are precipitated in the liquid/oil separator 6. The oil precipitated in the liquid/oil separator 6 is fed back to the compressor 1 through a capillary line 8, and the oil cycle is thus closed. The high pressure flow downstream of the liquid/oil separator 6 then flows through the heat exchanger 17. From the heat exchanger 17, which is preferably designed as a countercurrent heat exchanger, the high pressure flow is fed to the precooler 10 and then to the Joule Thomson heat exchanger 3. The refrigerant mixture is cooled by the precooler 10, so that the refrigerant mixture is partially liquefied. The high pressure flow is cooled in the Joule Thomson heat exchanger 3 in countercurrent with the low pressure flow and finally expanded in the throttle component 4 into its two-phase range. After the throttling, the refrigerant mixture is partially evaporated in the evaporator 5 with refrigerating power being output. The refrigerant mixture leaving the evaporator 5 is warmed in the Joule Thomson countercurrent heat exchanger 3. This low pressure flow is fed back to the compressor 1 via the heat exchanger 17. The cooling for the oil condenser 9 and the precooler 10 is provided by at least one additional refrigerating system 11.

The refrigerating system 11 preferably consists of a compressor 12, a condenser 13 and the throttle components 14 and 15. In addition, should need be, a further throttle component 16 may be arranged in the line downstream of the oil condenser 9.

FIG. 2 represents a refinement of the device for carrying out a mixture throttle process shown in FIG. 1. The precooler 10 downstream of the liquid/oil separation in the liquid/oil separator 6 is configured here as a triple-flow heat exchanger, through which the low pressure flow from the Joule Thomson heat exchanger 3 and the precooling medium from the refrigerating system 11 flow in countercurrent with the high pressure flow, and owing to which the heat exchanger 17 is superfluous here. The cycle is especially efficient. The cooling for the precooler 10 and the oil condenser 9 is produced in at least one refrigerator 11.

The device according to FIG. 3 corresponds essentially to the device represented in FIG. 1, and the device according to FIG. 4 is essentially similar to the device represented in FIG. 2, an adsorber 7 being additionally arranged between the liquid/oil separator 6 and the heat exchanger 17, or respectively the triple-flow heat exchanger constituting the precooler 10. In these devices, the oil vapour components are additionally adsorbed from the refrigerant in the adsorber 7.

A variant of the device, which is advantageous in terms of equipment, is represented in FIG. 5. In this case, downstream of the aftercooler 2, the refrigerant is only cooled in the oil condenser 9 and the oil removal in the liquid/oil separator 6 is facilitated. After the oil separation, the oil vapors are adsorbed in an adsorber 7. The purified refrigerant enters the Joule Thomson heat exchanger 3 and is then processed further according to the prior art in accordance with a Joule Thomson process. The cooling for the oil condenser 9 is produced by a refrigerator 11.

The device represented in FIG. 6 only has a liquid/oil separator 6 for removing the oil from the refrigerant mixture. In this device, no adsorber 7 is needed. The cooling for the oil condenser 9 is produced in a refrigerator 11.

What is claimed is:

1. Process for refrigeration in the 65 to 150 K temperature range, in which the refrigerant is compressed using an oil-lubricated compressor, then cooled to ambient temperature and then oil is removed from the refrigerant before the refrigerant is feed to a Joule Thomson heat exchanger, characterized in that the refrigerant emerging from the compressor is cooled to a temperature below ambient temperature but still remains in the gaseous state before it is fed to the compressor, and the refrigerant is additionally cooled after it has been cooled to ambient temperature and before it enters the Joule Thomson heat exchanger.

2. Process according to claim 1, characterized in that the refrigerant is additionally cooled after it has been cooled to ambient temperature and before the oil is removed.

3. Process according to claim 1, characterized in that the refrigerant is additionally cooled after the oil has been removed and before entering the Joule Thomson heat exchanger.

4. Process according to claim 1, characterized in that the refrigerant has a temperature of from 233 to 243 K before entering the Joule Thomson heat exchanger.

5. Process according to one of claim 1, characterized in that the pressure of the refrigerant is from 1 to 3 bar, and particularly preferably from 1.6 to 1.8 bar before it enters the oil-lubricated compressor, and in that the refrigerant has a pressure from 10 to 28 bar and particularly after it has been compressed in the oil-lubricated compressor.

6. Process according to claim 5, characterized in that the pressure of the refrigerant before it enters the compressor is from 1.5 to 2.5 bar.

7. Process according to claim 6, characterized in that the pressure of the refrigerant before it enters the compressor is from 1.6 to 1.8 bar.

8. Process according to claim 5, characterized in that the refrigerant has a pressure of from 12 to 18 bar after it has been compressed.

9. Process according to claim 8, characterized in that the refrigerant has a pressure of from 14 to 16 bar after it has been compressed.

10. Process according to claim 1, characterized in that predominantly liquid oil components are removed from the refrigerant after the refrigerant has been cooled to ambient temperature.

11. Process according to claim 10, characterized in that after the predominantly liquid oil component has been removed from the refrigerant, the predominantly vapour oil component is then removed from the refrigerant.

12. Process according to claim 1, characterized in that a mixture containing nitrogen, methane, propane and ethane or ethylene is used as the refrigerant.

13. Process according to claim 12, characterized in that the mixture contains from 25 to 45 mol % nitrogen, from 15 to 42 mol % methane and from 5 to 25 mol % propane, the remainder being ethane or ethylene.

14. Device for refrigeration in the 65 to 150 K temperature range, which has an oil-lubricated compressor for compressing a refrigerant, an aftercooler connected downstream for cooling the refrigerant to ambient temperature, a device following on from this for removing oil from the refrigerant and a Joule Thomson countercurrent heat exchanger connected downstream of the device for removing the oil, characterized in that an oil condenser is arranged between the aftercooler and the Joule Thomson countercurrent heat exchanger, and the oil condenser cooling the refrigerant to a temperature below ambient temperature and being connected downstream to the aftercooler and upstream to the oil separator.

15. Device according to claim 14, characterized in that the oil condenser is arranged after the aftercooler and before an oil device.

16. Device according to claim 15, characterized in that an adsorber is arranged after the oil separation device and before the Joule Thomson countercurrent heat exchanger.

17. Device according to claim 14, characterized in that a precooler is arranged after the aftercooler and after the oil separation device.

18. Device according to claim 17, characterized in that at least one of the oil condenser the precooler is integrated as the evaporator in a separate refrigerating cycle.

19. Device according to claim 17, characterized in that a heat exchanger is arranged after the oil separation device or after the adsorber and before the precooler.

20. Device according to claim 19, characterized in that the precooler is configured as a triple-flow heat exchanger through which the refrigerant flow from the Joule Thomson heat exchanger and the flow of refrigerant from the separate refrigerating cycle are fed in countercurrent to the refrigerant flow from the oil separation device or the adsorber.

* * * * *